US006266927B1

(12) United States Patent
Leslie

(10) Patent No.: US 6,266,927 B1
(45) Date of Patent: Jul. 31, 2001

(54) FAN DOME AND SUPPORTIVE MEANS

(76) Inventor: Thomas A. Leslie, 419 W. Lincoln Rd. - Apt. #F2, Kokomo, IN (US) 46904-2723

( * ) Notice: Subject to any disclaimer, the term of this patent is extended or adjusted under 35 U.S.C. 154(b) by 0 days.

(21) Appl. No.: 09/272,492

(22) Filed: Mar. 19, 1999

(51) Int. Cl.[7] ..... E04B 1/70

(52) U.S. Cl. ..... 52/2.17; 52/2.25; 52/2.26; 52/2.18; 52/DIG. 13

(58) Field of Search ..... 52/2.17, 2.23, 52/2.26, 23, DIG. 13, 2.18, 2.14; 454/255

(56) References Cited

U.S. PATENT DOCUMENTS 3,250,024 * 5/1966 Douthitt et al. ..... 52/2.14 X
3,335,529 * 8/1967 Gedney ..... 52/2.14
3,353,309 * 11/1967 Kwake ..... 52/2.14
3,839,832 * 10/1974 Kastner ..... 52/2.14
4,164,829 * 8/1979 Sadler ..... 52/2.14
4,505,481 * 3/1985 Knight ..... 273/348.1
5,970,661 * 10/1999 Bishop et al. ..... 52/2.11

FOREIGN PATENT DOCUMENTS

2024588 * 9/1978 (GB) ..... 52/2.26

* cited by examiner

*Primary Examiner*—Carl D. Friedman
*Assistant Examiner*—Phi Dieu Tran A
(74) *Attorney, Agent, or Firm*—Robert A. Spray

(57) ABSTRACT

Dome-type apparatus formed largely of flexible sheeting, with a fan or blower means inflatable to provide a chamber large enough to accommodate one or more human beings. The apparatus is also provided to be usable by just the fan or blower means without the dome member, so as to provide utility on occasions in which the dome member is not to be used.

8 Claims, 4 Drawing Sheets

FAN DOME AND SUPPORTIVE MEANS

I. FIELD AND BACKGROUND OF THE INVENTION

The present invention relates to a dome-type apparatus formed largely of flexible sheeting, which is provided with a fan or blower means inflatable to provide a chamber large enough to accommodate one or more human beings.

More particularly, the apparatus is also provided to be usable by just the fan or blower means without the dome member, so as to provide utility on occasions in which the dome member is not to be used.

II. PROBLEMS INHERENT AS TO THE PROVISION OF THESE FEATURES IN APPARATUS OF PARTICULAR PURPOSES SUCH AS HERE PROVIDED

Several problems and/or conditions need to be considered in providing the multi-purpose utility apparatus of the present invention.

That is, the dome member has to be sufficiently strong as to accommodate repeated inflation and deflation without tearing, yet it is desirably quite light in weight, and provision must be had for suitable support of it in its inflated or operational condition. It should be conventiently changed from inflated and deflated condition, for movement between temporary locations of usage and storage. Its operativity should be readily apparent to users of even pre-teen years. Although it should be operatively tight and leak-proof, it should be of a nature such that ventilation is assured for breathing. Control should be operable from either the outside or the inside of the dome. The dome should be readily removable from supporting structure when the blower effect from the fan is desired without the provision of the dome as a chamber. Lighting should be provided for adequate illumination inside the dome chamber. The assembly should be economical, should be interest-attracting, and should be of long-term dependability.

The above factors and/or conditions are not readily provided for in an accumulative sense, by conventional tent-like structures, even though, as herein provided, apparatus of the present invention can be seen to provide a novel, attractive, and interest-inducing apparatus.

III. SUMMARY OF THE PRESENT INVENTION

In an abbreviated summary the present invention provides, in a first embodiment, an inflatable dome member formed of flexible sheeting and a fan means assembly to which the dome member is releasably connectable by Velcro. A light bulb illuminates the dome member, and is controlable by a switch which is accessible from either within or without the dome chamber.

In a second embodiment, the fan means is usable without the dome, the connection of those members being conveniently releasable.

IV. PRIOR ART CAPABILITY AND MOTIVATIONS, AS HELPING TO SHOW PATENTABILITY HERE

In hindsight consideration of the present invention to determine its inventive and novel nature, it is not only conceded but emphasized that the prior art had details usable in this invention, but only if the prior art had had the guidance of the present concepts of the present invention, details of both capability and motivation.

That is, it is emphasized that the prior art had or knew several particulars which individually and accumulatively help to show the non-obviousness of this combination invention E.g., a. The prior art has had several features which contribute functionally toward this invention, such as roofs of various natures, electric fans, air-support of flexible dome-like roofing features, and various types of electrical apparatus and controls therefor, etc.

b. Such a huge number of variations of these apparatus or devices help to show that the novelty here is to be considered as inventive, for they show that this may be considered as quite a "crowded art"; and especially is this consideration logical when it is noted that shelters are such "simple" and well-known things from the standpoint of their simplicity of construction;

c. The relative simplicity of shelders, as an item of construction, has surely given manufacturers ample incentive to have made modifications for commercial competitiveness in a competitive industry with huge sales prospects reasonably expectable;

d. The prior art has always had sufficient skill to make many types of shelters, more than ample skill to have achieved the present invention, but only if the concepts and their combinations had been conceived;

e. Substantially all of the operational characteristics and advantages of details of the present invention, when considered separately from one another and when considered separately from the present invention's details and accomplishment of the details, are within the skill of persons of various arts, but only when considered away from the integrated and novel combination of concepts which by their cooperative combination achieves this advantageous invention;

f. The details of the present invention, when considered solely from the standpoint of construction, are relatively simple, and the matter of simplicity of construction has long been recognized as indicative of inventive creativity;

g. The prior art has shown that it is willing to use and undertake developments of various factors of shelter design;

h. Similarly, and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate;

i. The prior art has long had mechanisms and production equipment of various kinds which could produce all of the particulars of the present invention;

j. The cost of manufacture of inflatable shelters, even including the extra cost of various features, appealable to children is sufficiently low as to be within the marketability or supposed-marketability in this aggressive industry;

k. Accordingly, although the prior art has had capability and motivation, amply sufficient to presumably give incentive to the development of specilized inflatable shelters according to the present invention, the fact remains that the present invention awaited the creativity and inventive discovery of the present inventor. In spite of ample motivation and capability shown by the illustrations herein, the prior art did not suggest this invention.

V. PRIOR ART FACTORS, AS PARTICULAR INSTANCES OF FAILURE TO ACHIEVE THE PRESENT CONCEPTS

In view of all of these factors of capability and motivation, it may be difficult to realize that the particular combination of features which cooperate to provide those inflatable shelters has not been conceived, even though the equipment industry development is quite commercial and competitive. Further, the persons of sufficient knowledge and skill to have achieved this combination surely include a multitude of manufacturers and parents, such that this combination invention would have come about if its concepts had been obvious.

Some prior art has come to the attention of this inventor after his invention and his consideration of a patent award, and is illustrated by the volumnious types of developments of comparable apparatus and cooperating features.

Search efforts have shown the prior art as illustrated in the following U.S. patents and ones cited therein:

| | |
|---|---|
| Des. 274,638 | Henry |
| 4,271,642 | Karr |
| 4,556,391 | Tardivel et al |
| 5,345,961 | Yercha et al |
| 5,437,126 | Ramiro |
| 5,471,797 | Murphy |
| 5,603,185 | Murphy |
| 5,636,478 | Chen |
| 5,678,357 | Rubio et al |

Of interest are the Murphy U.S. Pat. Nos. 5,471,797 and 5,603,185, as disclosing tents inflated by an air pump and having a design on the exterior thereof.

The use of VELCRO for fastening portions of a tent or the like is disclosed in the Ramiro U.S. Pat. No. 5,437,126, Chen U.S. Pat. No. 5,636,478 and Rubio et al Patent Number 5,678,357.

Without implying thoroughness, such prior art through the years illustrates the long-continuing inventorship and developments, but none shows or suggests the present invention of cooperating features.

VI. SUMMARY OF THE PRIOR ART'S LACK OF SUGGESTIONS OF THE CONCEPTS OF THE INVENTION'S COMBINATION

In spite of all such factors of the prior art, the problem here solved awaited this inventor's present creativity. More particularly as to the novelty here of the invention as considered as a whole, the candid reference to the prior art uses and needs helps to show its contrast to the present concepts, and emphasizes the advantages, novelty, and the inventive significance of the present concepts as are here shown, particularly as to salability, characteristics of use in practice and actual play, and confidence of use.

Moreover, prior art articles known to this inventor which could possibly be adapted for this duty fail to show or suggest the details of the present concepts as a combiantion; and a realistic consideration of the prior art's differences from the present concepts of the overall combination may more aptly be described as teaching away from the present invention's concepts, in contrast to suggesting them, even as to a hindsight attempt to perceive suggestions from a backward look into the prior art, especially since the prior art has long had much motivation as to details of the present invention and to its provisions.

And the existence of such prior art knowledge and related articles embodying such various features is not only conceded, it is emphasized; for as to the novelty here of the combination and of the invention as considered as a whole, a contrast to the prior art helps also to remind both the great variety of the various prior art articles and the needed attempts of improvement, and of the advantages and the inventive significance of the present concepts. Thus, as shown herein as a contrast to all the prior art, the inventive significance of the present concepts as a combination is emphasized and the nature of the concepts and their results can perhaps be easier understood.

Although varieties of prior art are conceded, and ample motivation is shown and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provides the merits of this invention, even though certain details are shown separately from this accomplishment as a combination.

And the prior art's lack of an invention of a combination device achieving the combination of interesting enjoyment in use, and other advantages of the present invention, which are goals only approached by the prior art, must be recognized as showing a long-felt need fulfilled.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VII. BRIEF DESCRIPTION OF THE DRAWINGS

The above description of the novel and advantageous invention is of somewhat introductory and generalized form. More particular details, concepts, and features are set forth in the following and more detailed description of two illustrative embodiments, taken in conjunction with the accompanying Drawings, which are of somewhat schematic and diagrammatic nature for showing the inventive concepts; and in the Drawings.

VIII. DETAILED DESCRIPTION OF ILLUSTRATIVE EMBODIMENTS

Figure 1:
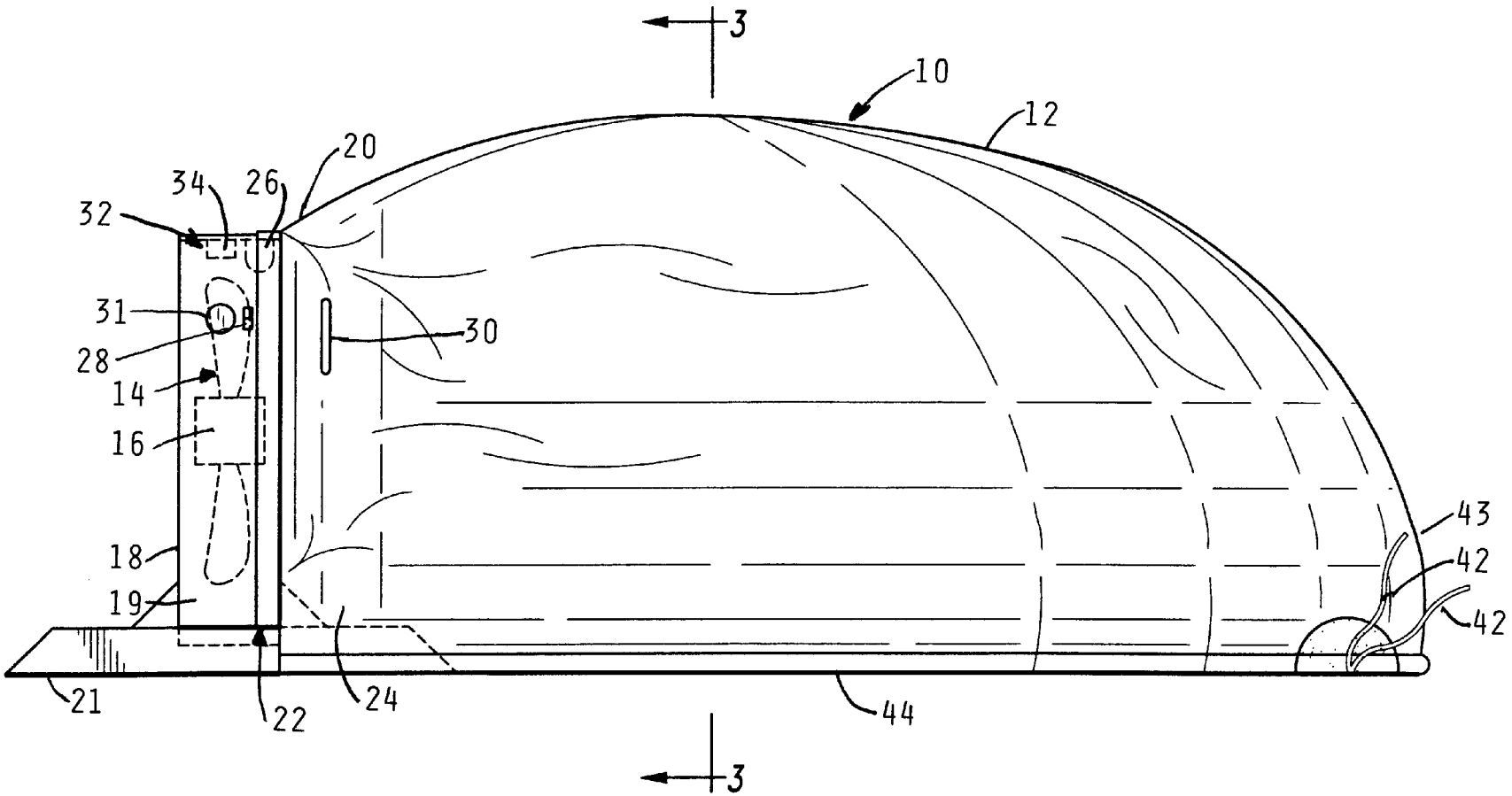
FIG. 1 is a side elevational view of a fan dome assembly according to a first embodiment, the view showing the assembly with the dome sheeting shown as inflated for its operational use.
Figure 2:
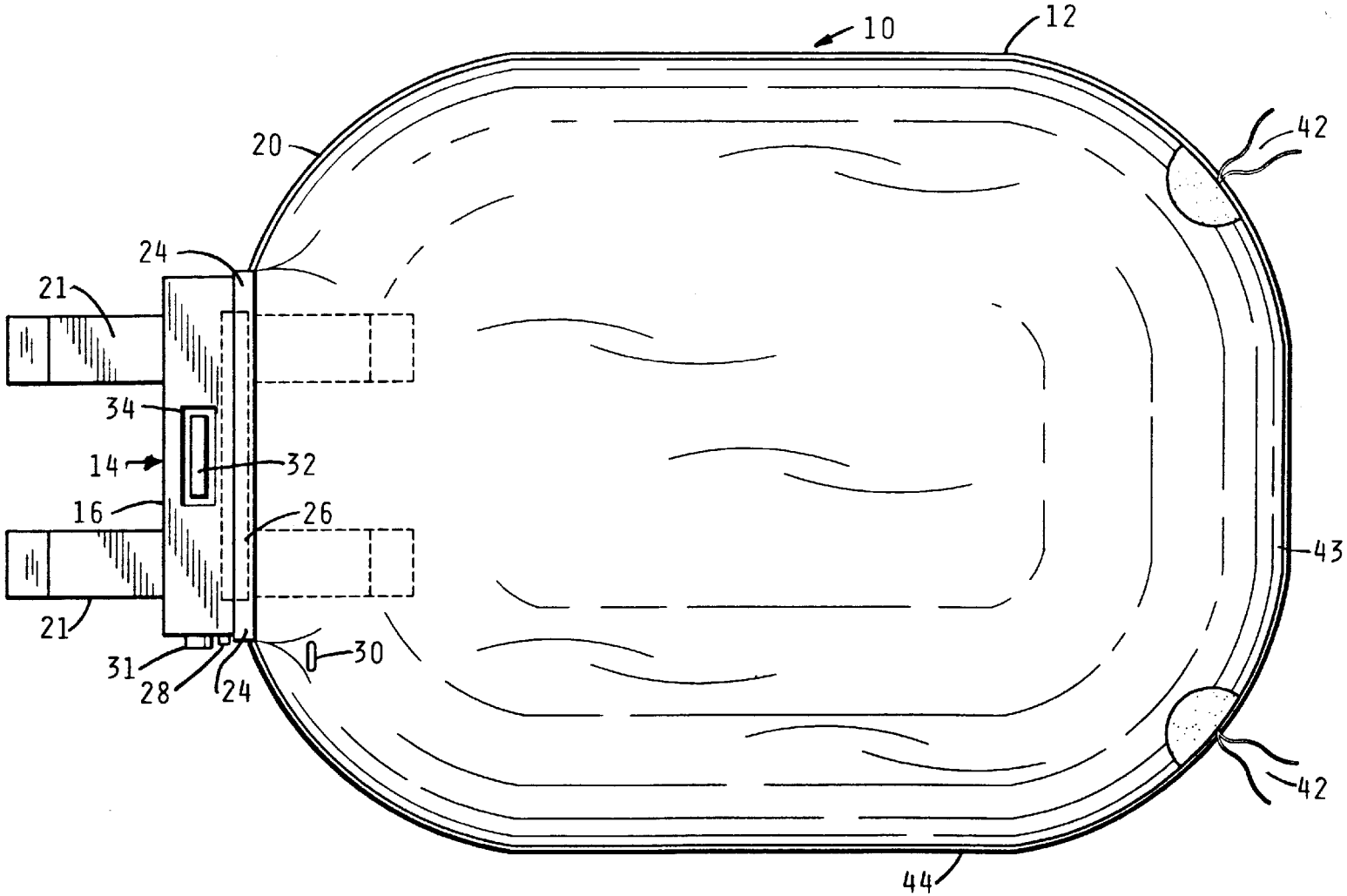
FIG. 2 is a plan view of the assembly shown in FIG. 1.
Figure 3:
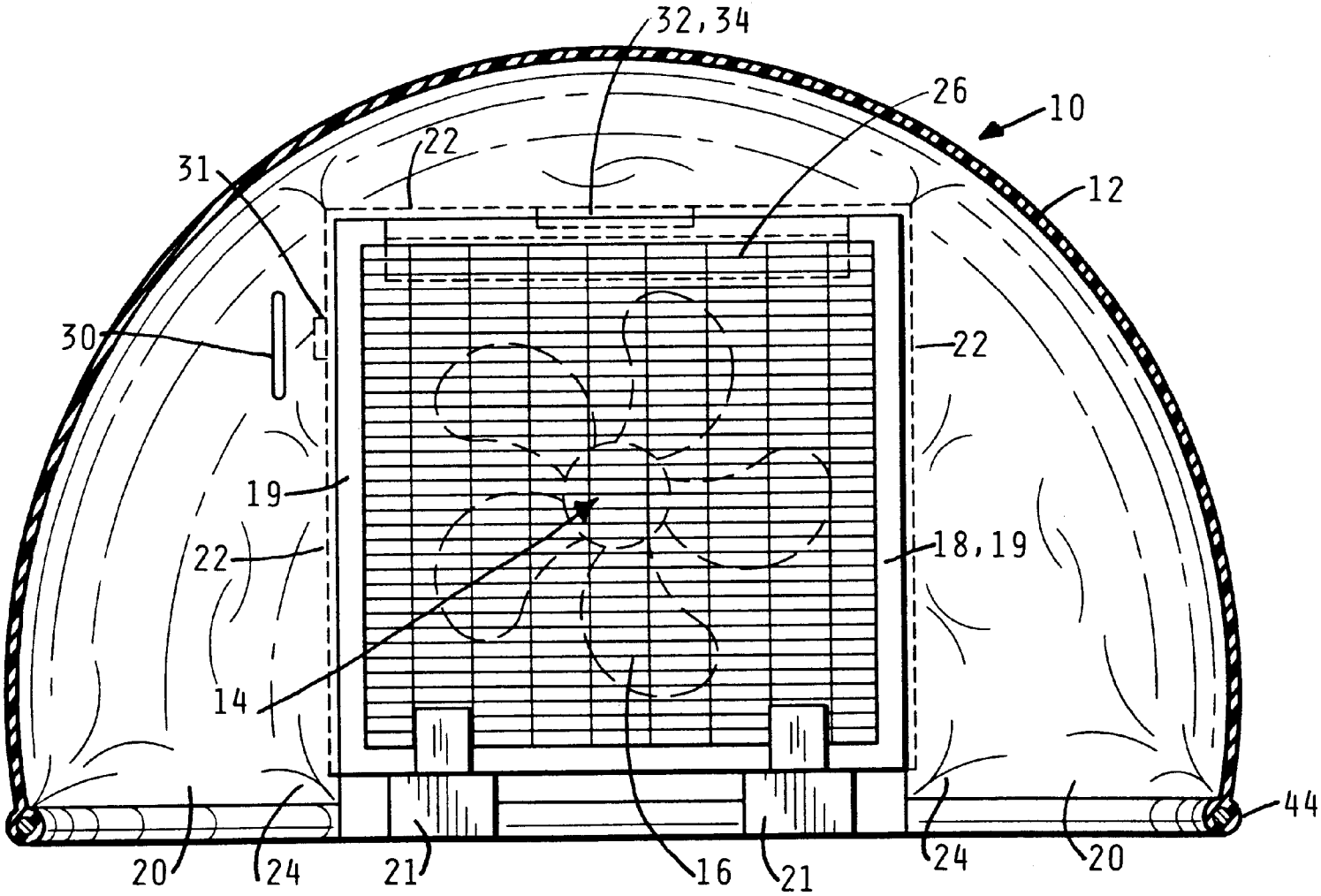
FIG. 3 is a vertical cross-sectional view of the assembly of FIGS. 1 and 2 as would be seen viewing leftwardly through the cutting plane indicated by Section-line 3—3 of FIG. 1, somewhat enlarged.

As shown in FIGS. 1–3 of the Drawings, a first embodiment shows a dome assembly 10. The dome assembly 10 comprises the combination of a dome member 12 which is formed of flexible sheeting means preferably of nylon or nylon-like material, and a fan means assembly 14 which includes a fan 16 and a generally rectangular housing means 18 which provides not only a shield for the fan 16 but also vertical supportive support means 19 laterally spaced for supporting the dome member 12 at its end which provides the opening for admission of air which is forced by the fan 16 into the under-side of the dome member 12 for supporting the dome member 12 in inflated operational condition. That air-admission end of dome member 12 is indicated by reference numeral 20.

Base member 21 supports each of the vertical supportive support means 19 of the housing means 18 by providing fore-and-aft support to the housing means 18.

There is provided co-operating Velcro hook and loop stripping 22 (FIG. 3) which respectively interconnects each side and the adjacent end (20) portion of the dome member 12 to the vertical supportive support means 19 for supporting the dome member 12 and holding its side edges 24 laterally spaced for accommodating passage of air through the fan assembly 14.

As shown, there is provided a laterally extending electric light bulb means 26 (preferably fluorescent) for illuminating the dome member 12, and there is provided an electric control switch means 28. There is access means here as slit 30, provided in the dome member 12 for control by the switch means 28, and for access to a control switch 31 which is provided for control of the inflation as well as the illumination, if desired.

Figure 5:
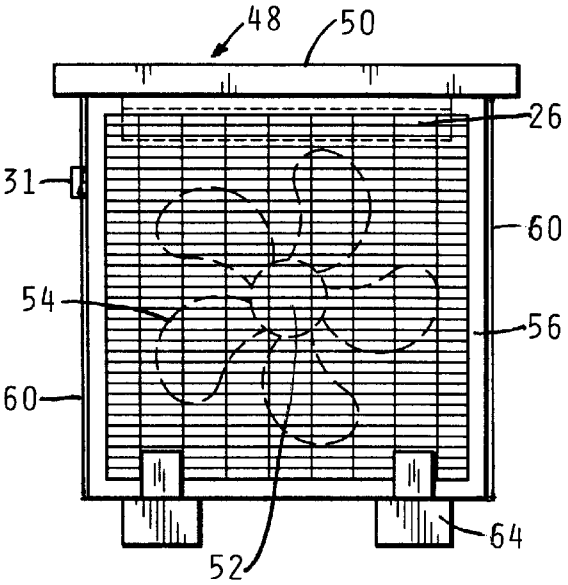
FIG. 5 is an end elevational view of the second embodiment.

A recessed handle 32 is shown in recess 34 for providing a means of moving the fan assembly cage 14; and the retractability of the of the handle 32 provides that the table top 50 may lie flat on the supporting structure 18 (46 in FIG. 5 embodiment).

Also as shown, the dome member 12 is provided with tie-down strap means 42 at a portion or portions 43 of the dome member 12 for the fan means assembly 14, for holding the dome member 12 in place when inflated, at least some portion 43 being spaced from the fan assembly 14.

The sheeting of the dome member 12 is provided with a rim means 44 which is stiffer than the flexibility of the sheeting of dome 12 but nevertheless sufficiently flexible as to permit it to be easily raised by a user person seeking to enter into the interior of the dome member chamber 12. The rim means 44 serves to maintain a generally elliptical shape of the bottom of the sheeting walls 12.

Figure 4:
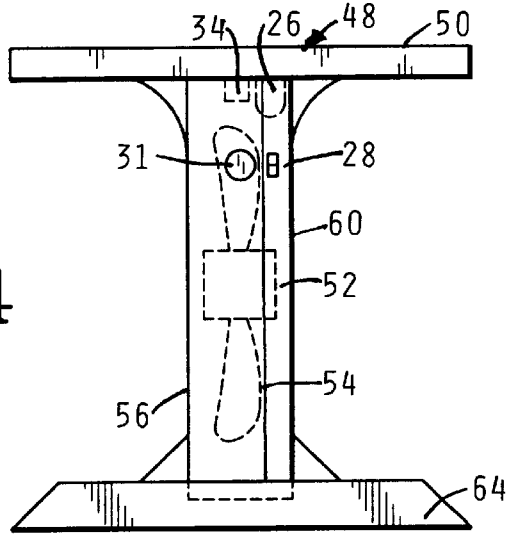
FIG. 4 is a side elevational view of a second embodiment, showing the supportive features of a dome assembly of FIG. 1, but, unlike the first embodiment, the second embodiment shows the dome removed, the supportive features for supporting a horizontal table panel rather than the dome of the first embodiment.
Figure 6:
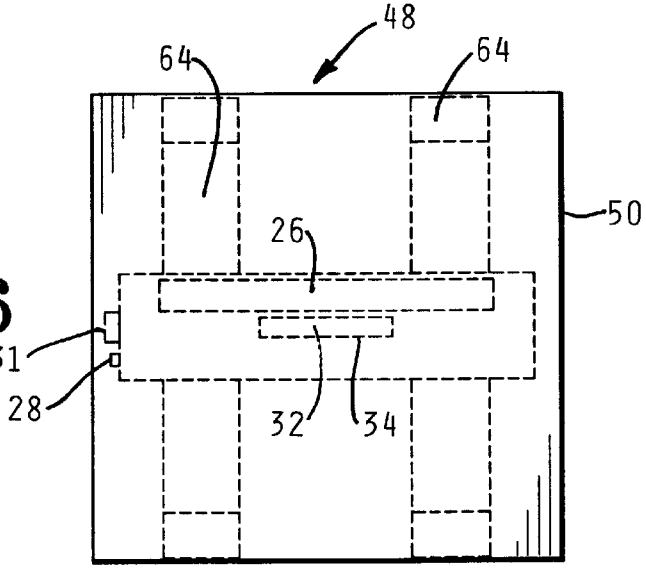
FIG. 6 is a plan view looking downward upon the top surface of the horizontal table panel of FIGS. 4 and 5.

Another desirable embodiment 48 is shown in FIGS. 4–6. As there shown, the combination 48 includes a table top 50 with a fan means 52 having a fan 54 and a generally rectangular shield 56. In this embodiment 48, the table top 50 is removable for optional use of the assembly 48, there being provided on the supportive shield 56 a Velcro means 60 which is optionally cooperative with an associated dome member for optional use of the assembly 48 as an inflatable dome assembly.

As with the first embodiment, for the assembly 48 there is provided a base member 64 for supporting each of vertical supportive support means 56 providing fore-and-aft support thereto.

IX. CONCLUSIONS AS TO INVENTIVE COMBINATION

It is thus seen that an inflatable shelter, formed according to the combination of inventive concepts and details herein set forth, provides novel concepts of a desirable and usefully advantageous article, yielding advantages which are and which provide special and particular advantages when used for a special-nature shelter.

In summary as to the nature of the overall installation's advantageous concepts, their novelty and inventive combination is shown by novel features of concept and construction shown here in advantageous combination and by the novel combinations hereof not only being different from all prior art known, even though many other installations of various assemblies have been known and used for scores of years, but because the achievement is not what is or has been suggested to those of ordinary skill in the art, especially realistically considering this as a novel combination comprising components which individually are similar in nature to what is well known to most all persons, surely including most of the many makers and parents and users for a great number of years throughout the entire world. No prior art component or element has even suggested the modifications of any other prior art to achieve the particulars of the novel concepts of the overall combination here achieved, with the special advantages which the overall combination article provides; and this lack of suggestion by any prior art has been in spite of the long worldwide use of various types of changeable-installations as play shelters.

The differences of concept and construction as specified herein yield advantages over the prior art; and the lack of this invention by the prior art, as an inventive combination, has been in spite of this invention's apparent simplicity of the construction once the concepts have been conceived, in spite of the advantages it would have given, and in spite of the availability of all of the materials to all persons of the entire world, and the invention's relatively non-technical and openly-visible nature.

Quite certainly this particular combination of prior art details as here presented in this overall combination has not been suggested by the prior art, this achievement in its particular details and utility being a substantial and advantageous departure from prior art, even though the prior art has had somewhat similar components separately for numbers of years.

Particularly is the overall difference from the prior art significant when the non-obviousness is viewed by a consideration of the subject matter of this overall device as a whole, as a combination integrally incorporating features different in their combination from the prior art, in contrast to merely separate details themselves, and further in view of the prior art of a shelter device of this type not achieving particular advantage here achieved by this combination.

Accordingly, it will thus be seen from the foregoing description of the invention according to the illustrative embodiments, considered with the accompanying Drawings, that the present invention provides new and useful concepts of a novel and advantageous article, possessing and yielding desired advantages and characteristics in formation and use, and accomplishing the intended objects including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

What is claimed is:

1. A dome assembly comprising, in combination, a dome member formed of flexible sheeting means, and a fan means assembly including a fan and a generally rectangular housing means providing both a shield for the fan and also vertical supportive support means laterally spaced supporting the dome member at an end thereof;

there being provided co-operating hook and loop stripping features respectively interconnecting each side and an adjacent end portion of the dome member to the vertical supportive support means for supporting the dome member and holding the side edges thereof laterally spaced for accommodating passage of air through the fan assembly, the dome member itself being fully self-supporting from the ground or base upon which the dome assembly is placed, when operatively inflated with air from the fan means assembly, without the use of supportive-framing side walls, thereby accommodating the folding of the dome member into a retracted condition for transport and storage, the sidewalls and the top wall being of a unitary nature, and in which the sheeting of the dome member is provided with a rim means, stiffer than the flexibility of the sheeting but nevertheless sufficiently flexible as to permit it to be easily raised by a user person seeking to enter into the dome member.

2. A dome assembly as set forth in claim 1, in which the fan means assembly includes a base member supporting each of the vertical supportive support means by providing fore-and-aft support thereto.

3. A dome assembly as set forth in claim 1, in which there is provided a laterally extending electric light bulb means for illuminating the dome member, there being provided an electric control switch means, and there being access means provided in the dome member for control by the switch means.

4. A dome assembly accoring to claim 1, in which the dome member is provided with tie-down strap means at a portion thereof remote from the connection of the dome member to the fan means, for holding the dome member in place when inflated.

5. A dome assembly as set forth in claim 1, in which the dome member is provided by flexible sheeting of nylon.

6. A dome assembly as set forth in claim 5, in which there is provided a base member for supporting each of the vertical supportive support means by providing fore-and-aft support thereto.

7. The invention as set forth in claim 1, in which the combination also comprises a table top, the table top being removable for optional use of the assembly, the hook and loop means optionally cooperative with the associated dome member for optional use of the assembly as an inflatable dome assembly.

8. An assembly as set forth in claim 7, in which there is provided a base member supporting each of the vertical supportive support means by providing fore-and-after support thereto.

* * * * *